US009095825B2

(12) United States Patent
Gilmore et al.

(10) Patent No.: US 9,095,825 B2
(45) Date of Patent: Aug. 4, 2015

(54) FLUID INJECTION SYSTEM

(71) Applicant: EZ-FLO Injection Systems, Inc., Sewickley, PA (US)

(72) Inventors: Dan Gilmore, Granite Bay, CA (US); Jeff Gilmore, Granite Bay, CA (US)

(73) Assignee: EZ-FLO Injection Systems, Inc., Freedom, PA (US)

( * ) Notice: Subject to any disclaimer, the term of this patent is extended or adjusted under 35 U.S.C. 154(b) by 0 days.

(21) Appl. No.: 14/072,873

(22) Filed: Nov. 6, 2013

(65) Prior Publication Data

US 2014/0124045 A1 May 8, 2014

Related U.S. Application Data

(60) Provisional application No. 61/723,504, filed on Nov. 7, 2012.

(51) Int. Cl.

| | |
|---|---|
| ***B01F 3/00*** | (2006.01) |
| ***B01F 1/00*** | (2006.01) |
| ***B01F 5/04*** | (2006.01) |
| ***B01F 3/08*** | (2006.01) |

(52) U.S. Cl.

CPC ..... *B01F 1/0022* (2013.01); *B01F 3/08* (2013.01); *B01F 5/0495* (2013.01); *B01F 5/0496* (2013.01)

(58) Field of Classification Search

CPC ..... B01F 5/0495; B01F 5/0496; B01F 3/08; B01F 3/00; B01F 1/0022

USPC ..... 137/268, 205.5; 422/263, 275, 282, 422/255, 256

See application file for complete search history.

(56) References Cited

U.S. PATENT DOCUMENTS

| | | | | |
|---|---|---|---|---|
| 3,166,096 | A * | 1/1965 | Lang | 422/256 |
| 3,809,291 | A | 5/1974 | Purdy | |
| 4,846,214 | A | 7/1989 | Strong | |
| 5,094,269 | A | 3/1992 | Agulia | |
| 5,484,106 | A | 1/1996 | Gilmond | |
| 5,544,810 | A | 8/1996 | Horvath, Jr. et al. | |
| 6,039,065 | A | 3/2000 | Gagliardo | |

(Continued)

OTHER PUBLICATIONS

Notification of Transmittal of the International Search Report and the Written Opinion of the International Searching Authority, International Search Report and Written Opinion of the International Searching Authority for PCT/US2013/068643, dated Apr. 14, 2014 (10 pages).

*Primary Examiner* — Kevin Lee

(74) *Attorney, Agent, or Firm* — Buchanan Ingersoll & Rooney PC

(57) ABSTRACT

Fluid injection system for dispensing a solution into a fluid flow in a flow line, the fluid injection system including a storage tank having product to be dispensed therein; an inlet connection diverting fluid from the flow line into the tank; an outlet connection returning a mixture of fluid/product back into the flow line; a metering gauge in fluid communication with the inlet connection measuring water flowing into the tank; and a tank head connected to the storage tank and having multiple ports for connection to the inlet connection depending on whether the product to be dispensed is in liquid dry form. The inlet connection includes an inlet probe having an opening defined by an arc at a downstream side. The outlet connection includes an outlet probe having an opening having an angled cut facing downstream, such that a pressure differential is created between the inlet and outlet probes.

13 Claims, 6 Drawing Sheets

(56) References Cited

U.S. PATENT DOCUMENTS

| | | | | |
|---|---|---|---|---|
| 6,419,168 | B1 | 7/2002 | Thieleke et al. | |
| 6,609,733 | B2 * | 8/2003 | Gilmore | 285/239 |
| 6,659,128 | B2 | 12/2003 | Gilmore | |
| 6,805,149 | B1 | 10/2004 | Gilmore | |
| 7,065,803 | B2 * | 6/2006 | Mock et al. | 422/264 |
| 7,798,166 | B1 | 9/2010 | Wachter | |
| 8,210,451 | B1 | 7/2012 | Gooch et al. | |
| 2004/0124253 | A1 | 7/2004 | Bergwin et al. | |

* cited by examiner

FLUID INJECTION SYSTEM

CROSS-REFERENCE TO RELATED APPLICATIONS

This patent application claims the benefit of U.S. Provisional Patent Application No. 61/723,504, filed on Nov. 7, 2012, which is hereby incorporated by reference in its entirety.

FIELD OF THE INVENTION

The present disclosure is generally directed toward fluid injection systems and, more particularly, toward aspiration type fluid injection systems for use with both liquid and water soluble dry products.

BACKGROUND OF THE INVENTION

A variety of devices and systems have been designed for use in injecting fluids and other dry soluble products into fluid streams. Such devices/systems include, for example, metering pumps, water powered pumps, siphon devices, flow through devices, gravity feed drainage equipment, etc. However, various problems are encountered with each type of device/system currently available in delivering an accurately proportioned injection amount, whether the injected product is a fluid or solid.

Metering pumps can either be set to inject a predetermined amount of product into a fluid stream without any means of adjusting to changes in flow volume in the fluid stream, or they can be set for electronic control by flow sensors located in the fluid stream. A disadvantage with metering pumps is that the components of this type of system are mechanical and electronic, so they are subject to wear and mechanical failure Water powered pumps adjust automatically to changes in flow in the fluid stream, but have the disadvantage that they are a mechanical device with a number of seal points. These seals require frequent maintenance for the unit to operate properly and not leak. Additionally, water powered pumps are generally limited in the amount of fluid flow they can operate with and, as the flow increases, the complexity and cost of the device will also generally increase.

Siphon devices generally rely on a high restriction in the fluid stream to create a venturi-type suction strong enough to pull the injection solution from the storage container into the fluid stream. However, siphon devices require high pressure to operate, and the high restriction in the fluid stream greatly reduces the fluid stream volume. A disadvantage is that fluctuations in pressure can cause the siphon device to not inject continuously, thus creating uneven distribution of the product into the fluid stream. Additionally, siphon devices are also unable to dependably inject solutions, such as water-soluble fertilizers, without plugging.

Venturi-type systems generally have relatively small flow orifices and, thus, the fertilizer solution has a tendency to settle. Such settling tends to create sedimentation that plugs the orifices causing system failure.

Flow through devices typically channel, or direct, the flow of the fluid stream through a container that holds a soluble product that slowly breaks down, releasing the product into the stream. However, flow through devices generally do not control the amount being distributed and can provide unreliable distribution into the fluid stream. It is also common for the soluble products to melt as they sit in the water in the tank while the system is not operating, resulting in a large amount of the soluble product being released when the system is restarted.

Several types of fluid injectors have been developed to proportion liquid or soluble fertilizers or chemicals into fluid piping systems. For example, U.S. Pat. No. 5,484,106 (the "'106 patent") accomplishes such a proportioned injection, but relies on a check valve to prevent the backflow of contaminants into the fluid stream. With this design, the outlet flow port connection needs to extend to the bottom of the storage tank to establish a consistent injection rate of fertilizers, which tend to have a higher specific gravity than the incoming water. When the outlet port connection is extended to the bottom of the storage tank, the system may develop an air pocket in the top of the storage tank that can only be eliminated by manually filling the tank with fluid, or by some other means of manually venting the system. If the air is not removed from the system, a potentially hazardous condition exists. Since air compresses under pressure, this creates a higher stress on the storage tank than fluids under pressure, and can cause the storage tank to rupture at much lower operating pressures. The presence of air also reduces the amount of fluid in the storage tank. This, in turn, limits the fluid available to mix with soluble products to turn them into an injectable solution, causing the system to not inject accurately or, possibly, to not inject at all due to plugged flow ports. Since there is no way for air to escape the storage tank, soluble products must be premixed and the tank filled with water before using the system. Many soluble products begin settling to the bottom of the tank immediately after being mixed, and continuous agitation is required to keep them in an injectable state. This requires extending the inlet port to near the bottom of the storage tank to direct flow through the soluble product and keep the product mixed. Also, the '106 patent design does not provide a means of injecting more than one solution from the same tank at independent ratios.

U.S. Pat. No. 4,846,214 (the "'214 patent") has an automatic mechanical air relief valve that vents air from the storage tank to the atmosphere. While it does evacuate the air from the tank automatically, the device is mechanical in nature so it is subject to wear and eventual failure. Additionally, it does not provide backflow protection, establish proportioning rates, or allow air to be vented through the piping system. Further, it also does not provide a means of injecting more than one solution from the storage tank at independent ratios.

U.S. Pat. No. 3,809,291 (the "'291 patent") discloses a gravity feed system that uses an internal mixing chamber to combine two liquids to be dispensed into a fluid stream. It requires an electrical controller, a pressure switch, and a float valve to control fluid flow into the tank.

U.S. Pat. No. 5,544,810 (the "'810 patent") utilizes a high pressure flow line to create a venturi-effect to draw multiple fluids from multiple unpressurized containers and accurately mix them into one solution. The system has an air vent to the atmosphere to prevent siphoning of fluid from the storage containers when the system is not operating. However, this design requires a high-pressure flow line to create enough vacuum to draw the mixed fluids from the containers. This creates a high restriction in the flow line, significantly reducing flow volume and pressure. It also requires multiple containers to store the various solutions, which requires piping connections between all of the containers used. Additionally, the '810 patent design cannot operate at low pressures or automatically mix dry products and keep them as an injectable solution.

U.S. Pat. No. 6,039,065 (the "'065 patent") discloses a mixing valve that combines liquids at controllable proportions. However, it does not provide for the injection of liquids into a flow line; only the mixing of incoming flows.

The above described patents are only exemplary of some of the devices currently known, and are not meant to provide an exhaustive list.

None of the current solutions accurately measure the injection rate of an aspiration type of injector. This is due to the continuous dilution of the mix in the tank, and/or not being able to measure the water flowing into the storage tank. The current solutions also cannot inject a small, continuous amount of a product into high flow rate. For such applications, pulse injectors are typically used. However, pulse injectors inject a small pulse of product every so often, which is less desirable than a continuous injection stream. Further, the current solutions cannot be interchangeably used effectively with both liquid and dry products.

The present disclosure is directed toward overcoming one or more of the above-identified problems.

OBJECTS AND ADVANTAGES

Some objects and advantages of the present disclosure are set forth below. These are exemplary only and are not considered to be exhaustive.

1. Method of measuring the injection rate of an aspiration type of injection system.
   a. Solves the problem of identifying the injection rate of an aspiration type of injection device with or without bypass mixing capability.
      i. Perform bypass mixing before the metering gauge and completely outside the tank. An adjustable bypass connection between the water in and fertilizer out lines enables the system to inject at very high injection ratios. Conversely, the bypass can be adjusted providing very low injection ratios. The adjustable bypass is installed in line in front of the metering gauge so the gauge only reads the water entering the tank. This provides an accurate reading of the injection rate.
   b. Provides the ability to accurately inject liquid or water soluble dry products and accurately identify the injection rate.
2. Use of vent proportioner ports eliminates the need for a bypass control to slow down injection rates while preventing plugging and siphoning while providing even metering.
   a. Change between liquid and water soluble dry products by redirecting incoming flow through flow configuration or valving.
   b. Controlled layering based on product density (liquid or dry).
3. Dip tubes provide effective clearing of tank contents.
   a. Horizontal jets clear tank side walls of sticky solutions and powders.
   b. Elements are washed to the bottom of the tank.
   c. Continuous agitation of the solution keeps products in suspension.
4. Fill system allows:
   a. Topping off of tank.
   b. Loading the tank with 2 to 3 times more powdered product the previous solutions.
5. Auto refill.
   a. Gravity fill for use in areas without electricity.
   b. Trigger fill by measuring specific gravity of products in the tank or their color, pH level, PPM, or with refillable bladder.
6. Current problem associated with prior art devices:
   a. Difficult to determine injection rate because a portion of incoming water is diverted into the tank and mixed with the solution, and a portion of the water is remixed with the fertilizer coming out of the tank via a bypass valve. This requires using a metering gauge to determine the PPM rate of the solution leaving the tank. The ability to measure the PPM rate varies depending on the product in the storage tank. For example, some products can be measured with a TDS meter, while others need to be measured through a chemical analysis.
7. High flow venturi fittings.
   a. Increase injection flow by: (1) increasing flow in the inlet fitting by reducing cavitation in the fitting; and (2) increasing flow out of the outlet fitting by increasing reduced pressure.
      i. Easier installation.
      ii. Reduces or eliminates requirement for flow restriction between inlet and outlet fittings.
   b. Eliminates the need to cut pipe—just drill a hole and attach a saddle or tap directly into the line.
   c. The high flow venturi fittings can also be molded.
8. Dual gauge tank head.
   a. Provides the ability to switch between dry and liquid products without changing the connection of the water in line.
9. Flow through design allows for faster or slower injection rates at higher flows.
10. The ability to create an adequate amount of differential pressure without affecting the water pressure or flow rate in the main flow line, and to be able to install this connection without cutting into the flow line.
11. The ability to measure and adjust the exact injection rate without the need for electronic or mechanical flow sensors or controllers.
12. The ability to inject accurate, measured amounts of a product (liquid or dry) without the need for electronic or mechanical pumps that are problematic due to constant maintenance or breakdown.
13. The ability to load the tank with dry powders and automatically inject them without plugging and in measured, accurate doses.
14. The ability to inject liquids or water soluble dry products with water flow through an aspiration-type of system with accuracy because the internal flow system prevents the continuous dilution of the product being injected.
15. The ability to install in any flow line without regard to material of construction (e.g., PVC, Ductile Iron, HDPE, Poly, Copper, Brass, etc.).

SUMMARY OF THE INVENTION

The inventive injection system is an aspiration-type injection system that is used to inject any liquid or dry water soluble product into a fluid flow line. The inventive system connects to a fluid flow line and directs flow from the flow line into a storage tank that contains the product(s) to be injected into the flow line. As the fluid enters the tank, it causes the product(s) in the tank to flow out of the tank and be injected back into the fluid flow line.

The fluid is drawn from the flow line into the tank, and then injected back into the flow line by creating a differential pressure between the inlet connection to the flow line and the outlet connection to the flow line. This is done by inserting an inlet probe facing into the fluid flow. The inlet probe has a long sweeping curve defining an arc that minimizes cavitation which, therefore, increases the amount of flow from the flow line into the tank. The arc can have a length, or radius, of approximately 45-degrees, and is cut generally parallel to the top. The radius of the arc will depend on the size of the inlet probe and can be chosen to create the most beneficial differential pressure. In a preferred form, the opening of the inlet probe is substantially vertical, but can also be angled slightly into the fluid flow. This reduces or eliminates the need for other means of creating a differential pressure, such as, for example, a valve or reduction in pipe size between the inlet and outlet connections. The outlet connection probe is generally straight with an angled cut opening at the end, with the opening facing downstream of the fluid flow. The angled cut can be approximately 30-55 degrees and, in a preferred form, is approximately 45-degrees. However, other angles can be implemented depending on the desired application and fluid flow rate. This creates a low pressure point at the end of the outlet probe as the fluid flows by it which helps draw product from the tank. This combination maximizes the differential pressure created between the two connections. The inlet and outlet probes can be installed on fittings that can be installed into the flow line or, alternately, they can be tapped directly into the line by using, for example, a pipe saddle or a pipe outlet fitting. The ability to tap the probes into the flow line reduces the cost and labor associated with cutting the pipe and installing a fitting.

The amount of product being injected is regulated by controlling the amount of fluid going into the tank with a metering valve or other means of fluid control. The amount of fluid is measured with a flow gauge on the inlet or outlet line. When fluid flow enters the tank, it is directed to the top of the tank when liquid products are being injected, and directed to both the top and bottom of the tank, as well as the sides, when water soluble powders are being injected. In this regard, the tank head can be provided with different connection ports communicating with different tank inlet ports to effectuate the desired inlet flow for both liquid products and dry products.

Directing the incoming fluid to the top of the tank with liquid products prevents the incoming fluid from mixing with the product in the tank and diluting it. Generally, the liquid products are at a higher specific gravity than the water, and the product being injected stays below the incoming fluid in the tank. The fluid/product going out of the tank is drawn from the bottom of the tank through an outlet dip tube.

Directing the incoming fluid to both the top and bottom (and sides) of the tank for water soluble dry products creates the same layering effect inside of the tank. The fluid is directed to the bottom of the tank through an inlet dip tube, and continually mixes and liquefies the water soluble powder turning it into an injectable solution. A vent port is positioned at the top of the outlet dip tube to prevent the outlet dip tube from plugging.

A fluid injection system for dispensing a solution into a fluid flow in a flow line is disclosed herein. In an exemplary embodiment, the fluid injection system includes a storage tank having a product to be dispensed therein; an inlet connection for diverting fluid from the flow line into the tank; an outlet connection for returning a mixture of fluid and/or product back into the flow line; a metering gauge in fluid communication with the inlet connection for measuring water flowing into the tank; and a tank head connected to the storage tank, the tank head having multiple ports for connection to the inlet connection depending on whether the product to be dispensed is a liquid product or a dry product, wherein the inlet connection includes an inlet probe having an opening facing into the fluid flow, the opening defined by an arc at a downstream side, wherein the outlet connection includes an outlet probe having an opening facing downstream of the fluid flow, the opening having an angled cut, and wherein the arc at the inlet probe and the angled cut at the outlet probe create a pressure differential for diverting water into and out of the storage tank.

The fluid injection system can further include a bypass connection connected between the inlet and outlet connections, the bypass connection diverting some of the fluid received at the inlet probe to the outlet probe without the diverted fluid entering the tank.

In one form, the tank head includes a dual tank head, which further includes a first metering gauge for use with dry soluble product and a second metering gauge for use with liquid products. The metering gauges include metering adjustment valves for adjusting the flow rate of fluid into the tank.

In a further form, the arc on the inlet probe has a radius of approximately 45-degrees, and the angled cut on the outlet probe has an angle of approximately 30-55 degrees.

In an additional exemplary embodiment, a fluid injection system for dispensing a fluid and/or product contained within a storage tank into a fluid flow in a flow line is disclosed. The fluid injection system including an inlet connection for diverting fluid from the flow line into the tank; an outlet connection for returning a mixture of fluid and/or product back into the flow line; a metering gauge in fluid communication with the inlet connection for measuring water flowing into the tank; and a tank head connected to the storage tank, the tank head having multiple ports for connection to the inlet connection depending on whether the product to be dispensed is a liquid product or a dry product, wherein the inlet connection includes an inlet probe having an opening facing into the fluid flow, the opening defined by an arc at a downstream side, wherein the outlet connection includes an outlet probe having an opening facing downstream of the fluid flow, the opening having an angled cut, and wherein the arc at the inlet probe and the angled cut at the outlet probe create a pressure differential for diverting water into and out of the storage tank. In one form, the system is removeably attachable to the tank.

In one form, the additional exemplary embodiment of the fluid injection system further includes a bypass connection connected between the inlet and outlet connections, the bypass connection diverting some of the fluid received at the inlet probe to the outlet probe without the diverted fluid entering the tank.

The tank head can include a dual tank head, wherein the dual tank head includes a first metering gauge for use with dry soluble product and a second metering gauge for use with liquid products. The metering gauges include a metering adjustment valves for adjusting the flow rate of fluid into the tank.

The arc on the inlet probe can have a radius of approximately 45-degrees, while the angled cut on the outlet probe can have an angle of approximately 30-55 degrees.

It is an object of the inventive fluid injection system to create an adequate amount of differential pressure between the inlet and outlet without affecting the water pressure or flow rate in the main flow line, and to be able to install this connection without cutting into the flow line.

It is a further object of the inventive fluid injection system to be able to measure and adjust the exact injection rate without the need for electronic or mechanical flow sensors or controllers.

It is yet a further object of the inventive fluid injection system to inject accurate, measured amounts of a product (liquid or dry) without the need for electronic or mechanical pumps that are problematic due to constant maintenance or breakdown.

It is still a further object of the inventive fluid injection system to load the tank with dry powders and automatically inject them without plugging and in measured, accurate doses It is another object of the inventive fluid injection system to inject liquids or water soluble dry products with water flow through an aspiration-type system with accuracy because the internal flow system prevents the continual dilution of the product being injected.

Various other objects, aspects and advantages of the present disclosure can be obtained from a study of the specification, the drawings, and the appended claims.

BRIEF DESCRIPTION OF THE DRAWINGS

Further possible embodiments of the inventive fluid injection system are shown in the drawings. The present invention is explained in the following in greater detail as an example, with reference to exemplary embodiments depicted in drawings. In the drawings.

DETAILED DESCRIPTION OF THE INVENTION

FIGS. 1-6 show a preferred embodiment(s) of the inventive fluid injection system. The Figures show basic side views of the inventive fluid injector and how it connects to a fluid flow line. The inventive system can be manufactured from various types of plastics, metals, and/or combinations of both. Plastic connections may be glued, threaded, or otherwise attached. Metal connections may be threaded, welded, braised, or otherwise attached.

Figure 1:
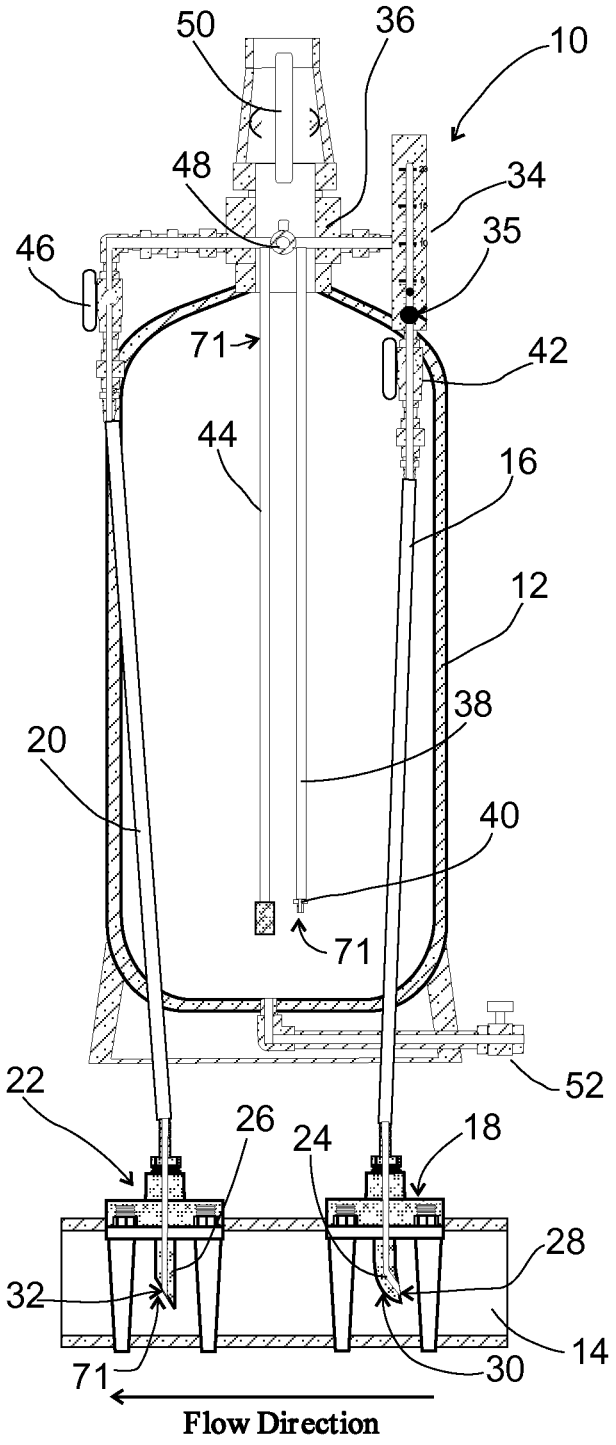
FIG. 1 shows an overview of the inventive system in operation and how it is connected to the fluid flow line.

As shown in FIG. 1, the system 10 includes a storage tank 12 connected to a water flow line 14. The tank inlet line 16 is connected to the fluid flow line 14 via a water inlet tap fitting 18. The tank outlet line 20 is connected to the fluid flow line 14 via a water outlet tap fitting 22. The fluid in the main line 14 is drawn into the tank 12 and injected back into the main line 14 by a pressure differential created between the inlet connection 18 and the outlet connection 22. This pressure differential is creating by probes 24 and 26 disposed in the main fluid flow line 14 at the inlet connection 18 and the outlet connection 22, respectively.

Figure 5:
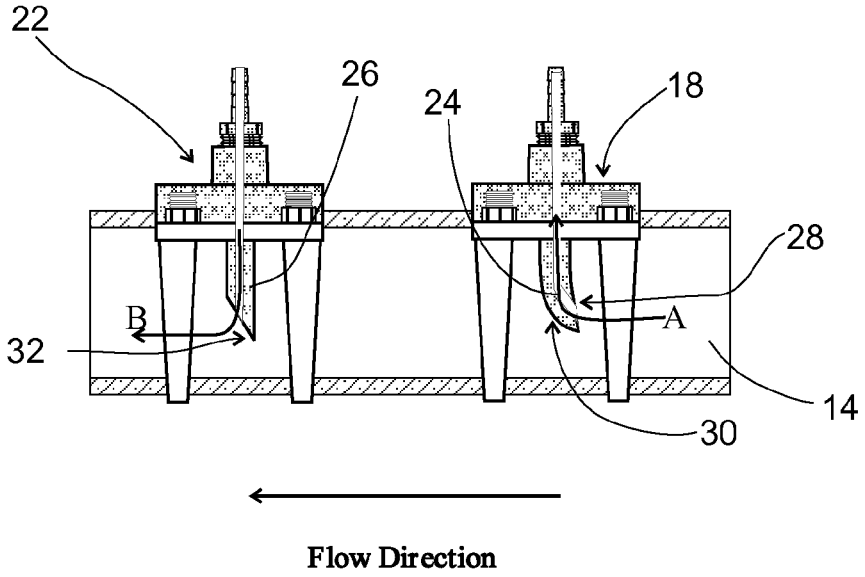
FIG. 5 shows the fluid inlet and outlet connections to the fluid flow line.

Referring to FIGS. 1 and 5, the inlet connection 18 includes the inlet probe 24, the opening 28 of which faces into the fluid flow. The opening 28 of the probe 24 is defined by a long sweeping curve, defining an arc, at 30, on a downstream side of the probe 24. In one form, the arc 30 may have a length of approximately 45-degrees, and is cut parallel to the top. The radius of the arc 30 will depend on the size of the inlet probe 24 and can be chosen to create the most beneficial differential pressure. The arc 30 minimizes cavitation which, therefore, increases the amount of flow from the flow line 14 into the tank 12. This, in turn, reduces or eliminates the need for other means of creating a differential pressure, such as, for example, a valve or reduction in pipe size between the inlet and outlet connections. The smooth long radius curve 30 on the inlet probe 24 increases flow capabilities by over 400% as compared to an angled cut. In a preferred form, the opening 28 of the inlet probe 24 into which the fluid flows is oriented substantially vertical, but can also be angled slightly into the fluid flow.

The outlet connection 22 includes the outlet probe 26, the opening 32 of which faces downstream of the fluid flow. The probe 26 is straight with an angled cut at the end defining the opening 32 at a downstream side of the probe 26. The angled cut 32 can be approximately 30-55 degrees and, in a preferred form, is approximately 45-degrees. However, other angles can be implemented depending on the desired application and fluid flow rate. Configuring the probe 26 in this manner creates a low pressure point at the end 32 of the outlet probe 26 as the fluid flows by it, which helps draw product from the tank 12. This combination of inlet 24 and outlet 26 probes maximizes the differential pressure created between the inlet and outlet connections to the main flow line 14.

Referring back to FIG. 1, the other end of the inlet line 16 is attached to a metering gauge 34, which also includes a metering adjustment valve 35. The metering gauge 34 is connected to an inlet port in the tank head 36, which directs the incoming water to the water inlet tube 38 (i.e., dip tube) and into the tank 12. As shown in the embodiment of FIG. 1, the water inlet tube 38 includes an opening near the bottom of the tank 12 which includes an agitation jet 40 thereon. A shut off valve 42 is provided before the metering gauge 34 to shut off flow to the tank 12. While not specifically shown in FIG. 1, the inlet water is also directed to the top of the tank 12 by attaching the inlet water line to a liquid injection/vent port in the tank head 36, as will be appreciated by one skilled in the art (see also FIG. 4).

The other end of the outlet line 20 is attached to the tank head 36 and is in fluid communication with the water outlet tube 44 (i.e., dip tube), which is also attached to the tank head 36. A shut off valve 46 is provided between the outlet line 20 and the tank head 36 to shut off flow from the tank 12.

The tank head 36 includes a vent valve 48 for venting air from the tank 12. The tank head also includes a fill valve 50 which is used for filling the tank 12 with liquid or dry product. The tank head 36 may be attached to the tank 12 via a screw fit, snap fit, or any other conventional means that will maintain a sufficient pressure in the tank 12. The tank 12 also includes a drain valve 52 for draining the tank 12 of its contents. The system 10 shown in FIG. 1 represents three points of mixing, indicated by reference number 71.

Figure 2:
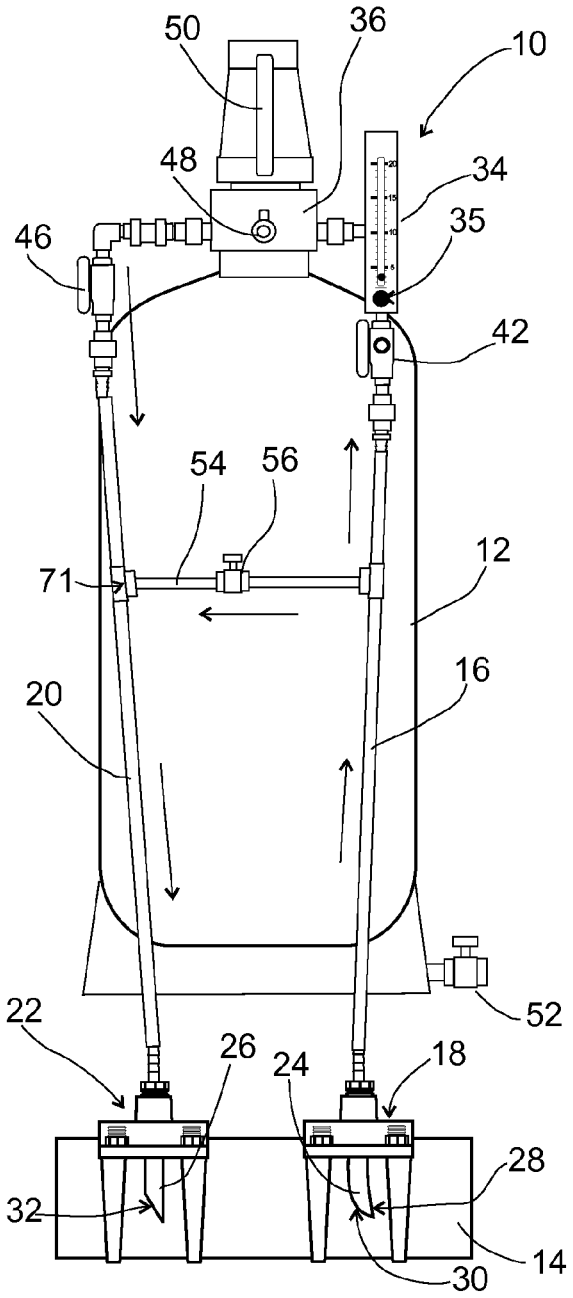
FIG. 2 shows an overview of the inventive system in operation with an adjustable bypass valve.

As show in FIG. 2, a bypass line 54 is provided between the inlet 16 and outlet 20 lines, the bypass line 54 having an adjustable bypass valve 56, which allows for very high injection ratios to be obtained (e.g., 300,000 to 1 and higher). The bypass valve 56 is installed on the outside of the tank 12 and before the metering gauge 34, so that the metering gauge 34 only reads the amount of fluid going into the tank 12, which gives an accurate reading of the injection rate. Any fluid bypassed by the bypass valve 56 will not be read by the metering gauge 34. The current design shown and described herein can be adjusted to offer one to five points of mixing to provide expanded injection rations. The addition of the bypass shown in FIG. 2 adds a fourth point of mixing to the design shown and describe in FIG. 1. However, one skilled in the art will appreciate that additional bypass connections and points of mixing may be added to adjust for injection ratios.

While not shown specifically in the Figures, the tank head 36 includes multiple ports which direct the incoming fluid into the tank 12 at different locations. These multiple ports allow the inventive system 10 to be used with both liquid and dry products, as will be appreciated by one of ordinary skill in the art. Additionally, while one inlet line 16 and one outlet line 20 are generally shown in the Figures, any number of inlet 16 and outlet 20 lines may be implemented (of the same or varying lengths) in a particular design to suit a particular application without departing from the spirit and scope of the present invention.

Figure 3:
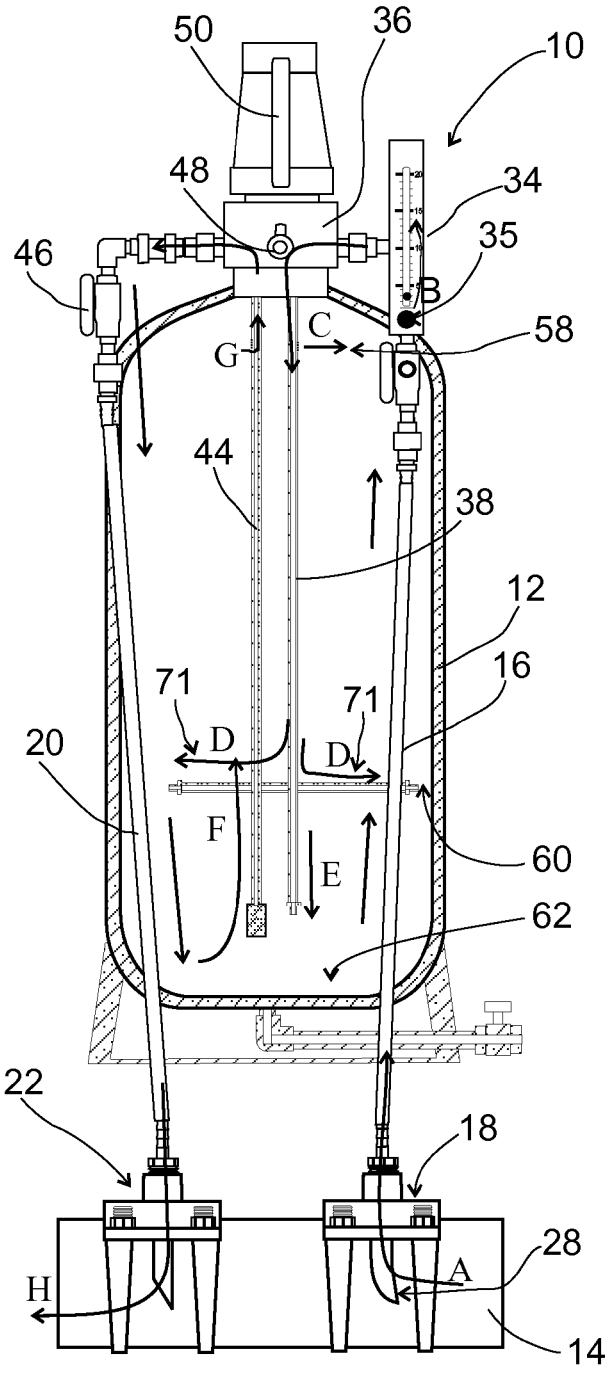
FIG. 3 shows an overview of the inventive system in operation for water soluble powdered product injection.

For example, as shown in FIG. 3, the inventive system 10 can be used for water soluble powdered product injection. Initially, the tank 12 is filled to the top with the powdered product via the fill valve 50, and the air is vented therefrom via the vent valve 48. After connection to the main flow line 14, water from the main flow line 14 is directed into the tank 12. The long radius curve of the inlet probe 24 reduces cavitation which increases flow into the tank 12 and eliminates the need for restriction in the irrigation line between the inlet 24 and outlet 26 probes to create injection. The fluid from the main flow line 14 enters the inlet probe 24 (arrow A), flows through the inlet line 16, the shut off valve 42, the metering gauge 34 (arrow B), the tank head 36, and into the tank 12. The incoming flow rate is measured by the metering gauge 34, and the flow rate shown is generally the injection rate of the product being injected. The metering valve 35 on the metering gauge 34 is used to adjust the flow rate. While the metering gauge 34 is shown connected to the inlet line 16, it may alternately be connected to the outlet line 20 without departing from the spirit and scope of the present invention. While not shown in FIG. 3, the bypass line 54 and bypass valve 56 can be included to further adjust the injection ratio.

The water inlet tube 38 directs the incoming water to various locations within the tank 12. The incoming water is directed over the top of the product, at 58 (arrow C), to the sides of the tank 12, at 60 (arrows D), and to the bottom of the tank 12, at 62 (arrow E). The water injected over the top of the product, at 58, creates a layering process that keeps the product being injected at the bottom of the tank 12, preventing dilution of the product and creating an even injection rate. In one form, the water injected over the top of the product is diffused to help further create the layering effect. The water injected at the sides of the tank 12, at 60, provides a fifth point of mixing 71 and washes off product that would otherwise stick to the sides of the tank 12, thus making the system 10 more effective in clearing the tank 12 of product. The water injected at the bottom of the tank 12, at 62, liquefies the water soluble product so it can be injected. The incoming water is injected at various levels to the various locations. For example, approximately 60-80% of the incoming water can be injected at the bottom 62, approximately 10-20% can be injected at the top 58, and approximately 0-20% can be injected at the sides 60. However, one skilled in the art will appreciate that other injects amounts and ratios can be implemented depending on the particular product and application involved without departing from the spirit and scope of the present invention.

As the dry product is liquefied, it is drawn out of the tank 12 though the water outlet tube 44 at the bottom of the tank 12 (arrow F). In one form, the water outlet tube 44 has a vent port (not shown) which prevents plugging and can be used to adjust injection rates (see e.g., arrow G). The outlet water containing mixed product flows up the outlet tube 44, through the tank head 36, the shut off valve 46, the outlet line 20, and into the main flow line 14 through the outlet probe 26 (arrow H). As previously noted, the outlet probe 26 includes the angled cut 32 which creates a low pressure point as water passes which increases the pressure differential created by the arc 28 in the inlet probe 24 at the inlet connection 18 to the main flow line 14.

It has been found that most water soluble dry products have basically the same flow rate. For example, approximately 1 gallon of water into the tank 12 equals approximately 2 pounds of dry product out. However, optimum flow rates for various water soluble dry products can be obtained by a person skilled in the art without undue experimentation.

Figure 4:
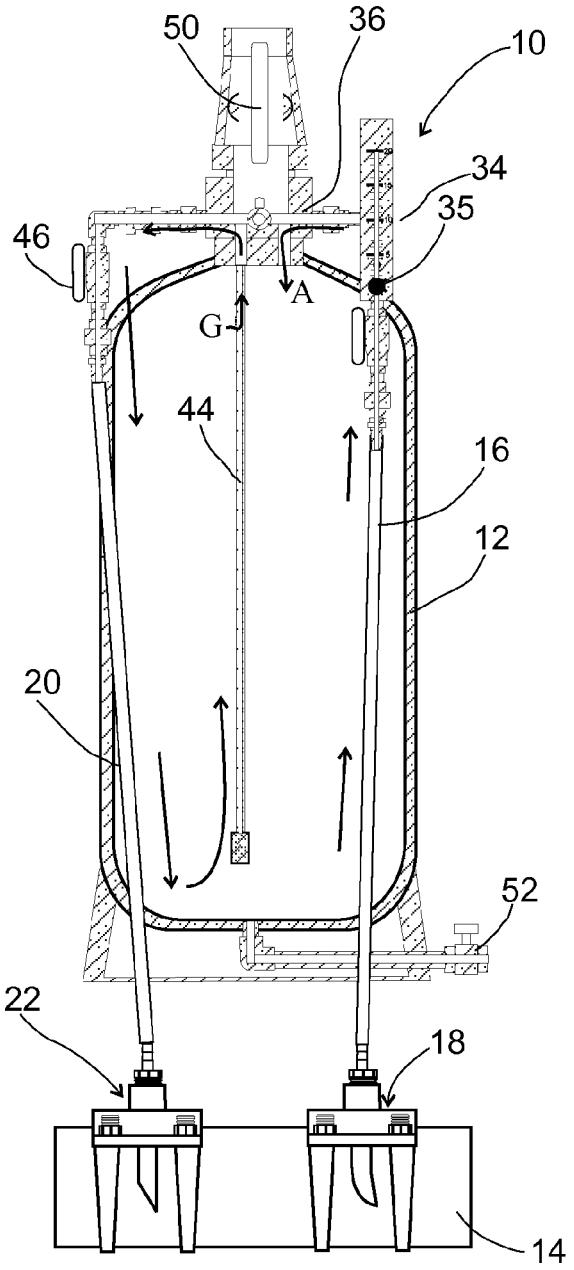
FIG. 4 shows an overview of the inventive system in operation for liquid product injection.

Additionally, as shown in FIG. 4, the inventive system 10 can be used for liquid product injection. Initially, the tank 12 is filled to the top with the liquid product via the fill valve 50, and the air is vented therefrom via the vent valve 48. After connection to the main flow line 14, the fluid from the main flow line 14 enters the inlet probe 24, flows through the inlet line 16, the shut off valve 42, the metering gauge 34, the tank head 36, and into the tank 12. The inlet water is directed into the top of the tank 12 by attaching the inlet water line to the liquid injection/vent port in the tank head 36 (arrow A). This can also be done by using a valve or other means to divert the water from the inlet line 16. Attaching the inlet water to the vent port in the tank head 36 bypasses all agitation eliminating the mixing in the tank 12 creating consistent injection rates of liquid products.

The incoming flow rate is measured by the metering gauge 34 and the flow rate shown is generally the injection rate of the product being injected. For liquid product, the flow rate of the product is essentially the same at the flow rate of the incoming water. For example, 1 gallon of water into the tank 12 means 1 gallon of liquid product out. The metering valve 35 on the metering gauge 34 is used to adjust the flow rate. While the metering gauge 34 is shown connected to the inlet line 16, it may alternately be connected to the outlet line 20 without departing from the spirit and scope of the present invention. While not shown in FIG. 4, the bypass line 54 and bypass valve 56 can be included to further adjust the injection ratio.

For liquid products, the water inlet tube 38 is generally not used. The incoming water is output from the tank head 36 to the top of the product. To prevent agitation of the product, the incoming water is generally diffused. The liquid product is drawn out of the tank 12 though the water outlet tube 44 at the bottom of the tank 12. In one form, the water outlet tube 44 has a vent port (not shown) which prevents plugging and can be used to adjust injection rates. The outlet water containing mixed product, flows up the outlet tube 44, through the tank head 36, the shut off valve 46, the outlet line 20, and into the main flow line 14 through the outlet probe 26. As previously noted, the outlet probe 26 includes the angled cut 32 which increases the pressure differential created by the arc 28 in the inlet probe 24 at the inlet connection 18 to the main flow line 14.

To allow use with both liquid and dry water soluble product, the tank head 36 can have alternate ports for connection to the inlet water, or may have valves which direct the inlet water to either the water inlet tube 38 (for dry water soluble product) or a diffuser (not shown) connected to the tank head 36 (for liquid product). The position of the liquid injection/vent port directs the incoming stream along the arc of the fill port cavity, reducing the velocity and turbulence, thus diffusing the agitation.

Figure 6:
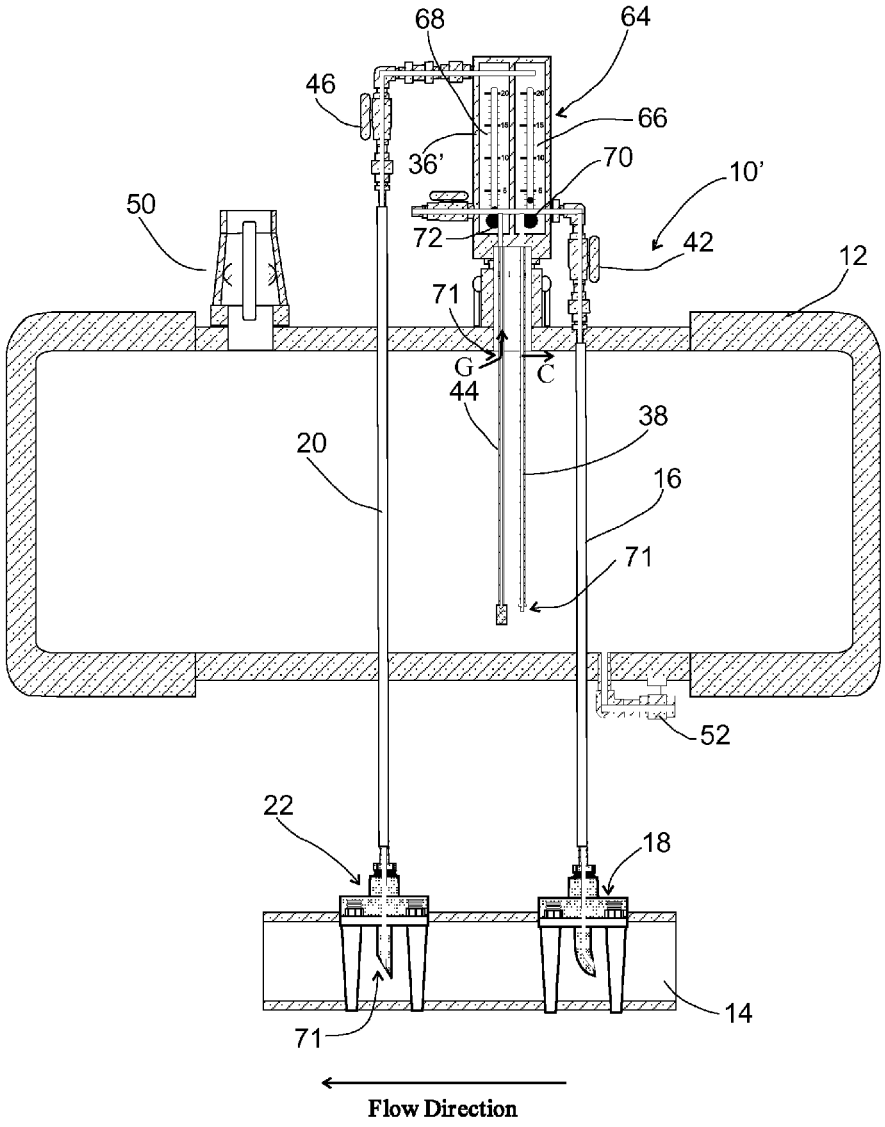
FIG. 6 shows an overview of the inventive system in operation and having dual metering gauges for liquid product and dry product injection.

In one form, as shown in FIG. 6, the inventive system 10' may include a dual tank head 64 for ease of changing between dry and liquid products and/or increasing the flow rate. The dual tank head 64 design enables changing between liquid and dry products by adjusting the metering gauges 66 and 68, and allows for faster injection rates of dry or liquid products. In FIG. 6, elements with the same function are identified with the same reference numbers, while elements requiring modification are indicated with a prime. The dual tank head 64 includes a first metering gauge 66 used for liquid product injection and a second metering gauge 68 used for dry product injection. When liquid product in injected, incoming water will be directed through the first metering gauge 66 and into the tank 12 via an appropriate port in the tank head 36' (connected to a diffuser) for input at the top of the tank 12 since liquid product is being injected. The metering valve 70 may be used to adjust the flow rate. When dry product is injected, incoming water will be directed through the second metering gauge 68 and into the tank 12 via the water inlet tube 38 and applied to the dry product at various locations in the tank 12 (e.g., top 58, sides 60 and bottom 62, as shown in FIG. 3). The metering valve 72 may be used to adjust the flow rate. Additionally, while not shown in FIG. 6, the bypass line 54 and bypass valve 56 can be included to further adjust the injection ratio.

As previously noted, the current design shown and described herein can be adjusted to offer one to five points of mixing to provide expanded injection rations. These points of mixing are indicated with reference number 71 and are shown in FIGS. 1, 2, 3 and 6. The five points of mixing 71 include: at the bottom of the tank 12 (see FIGS. 1 and 6); at the top of the tank 12 (see FIGS. 1 and 6); at outlet port 28 (see FIGS. 1 and 6); at the bypass 54 (see FIG. 2); and at the sides of the tank 12 (see FIG. 3). Of course, the present invention is not limited to five points of mixing, and other point of mixing may be added to adjust for injection ratios as will be appreciated by one skilled in the art.

The inventive system 10' has the advantage that it can easily be switched between injecting liquid and dry products, or possibly combinations of both. In that regard, the tank 12 may be divided into separate sections and the inlet water directed accordingly. The inventive system 10, 10' may be used to inject various types of products, both liquid and dry, including, but not limited to, fertilizers, insecticides, pesticides, fungicides, herbicides, acaricides, fumigants, miticides, biopesticides, plant growth stimulators, plant growth enhancers, proteins, and an infinitely possible variety of chemical substances.

It will be apparent to those skilled in the art that numerous modifications and variations of the described examples and embodiments are possible in light of the above teachings of the disclosure. The disclosed examples and embodiments are presented for purposes of illustration only. Other alternate embodiments may include some or all of the features disclosed herein. Therefore, it is the intent to cover all such modifications and alternate embodiments as may come within the true scope of this invention, which is to be given the full breadth thereof. Additionally, the disclosure of a range of values is a disclosure of every numerical value within that range.

We claim:

1. A fluid injection system for dispensing a solution into a fluid flow in a flow line, the fluid injection system comprising:

a storage tank having a product to be dispensed therein;

an inlet connection for diverting fluid from the flow line into the tank;

an outlet connection for returning a mixture of fluid and/or product back into the flow line;

a metering gauge in fluid communication with the inlet connection for measuring water flowing into the tank; and a tank head connected to the storage tank and in fluid communication with the inlet connection, wherein the inlet connection includes an inlet probe having an opening facing into the fluid flow, the opening defined by an arc at a downstream side, wherein the outlet connection includes an outlet probe having an opening facing downstream of the fluid flow, the opening having an angled cut, and wherein the arc at the inlet probe and the angled cut at the outlet probe create a pressure differential for diverting water into and out of the storage tank.

2. The fluid injection system of claim 1, further comprising a bypass connection connected between the inlet and outlet connections, the bypass connection diverting some of the fluid received at the inlet probe to the outlet probe without the diverted fluid entering the tank.

3. The fluid injection system of claim 1, wherein the tank head comprises a dual tank head, wherein the dual tank head comprises a first metering gauge for use with dry soluble product and a second metering gauge for use with liquid products.

4. The fluid injection system of claim 1, wherein the metering gauge includes a metering adjustment valve for adjusting the flow rate of fluid into the tank.

5. The fluid injection system of claim 1, wherein the arc on the inlet probe has a radius of approximately 45-degrees.

6. The fluid injection system of claim 1, wherein the angled cut on the outlet probe has an angle of approximately 30-55 degrees.

7. A fluid injection system for dispensing a fluid and/or product contained within a storage tank into a fluid flow in a flow line, the fluid injection system comprising:

an inlet connection for diverting fluid from the flow line into the tank;

an outlet connection for returning a mixture of fluid and/or product back into the flow line;

a metering gauge in fluid communication with the inlet connection for measuring water flowing into the tank; and a tank head connected to the storage tank and in fluid communication with the inlet connection, wherein the inlet connection includes an inlet probe having an opening facing into the fluid flow, the opening defined by an arc at a downstream side, wherein the outlet connection includes an outlet probe having an opening facing downstream of the fluid flow, the opening having an angled cut, and wherein the arc at the inlet probe and the angled cut at the outlet probe create a pressure differential for diverting water into and out of the storage tank.

8. The fluid injection system of claim 7, wherein the system is removeably attachable to the tank.

9. The fluid injection system of claim 7, further comprising a bypass connection connected between the inlet and outlet connections, the bypass connection diverting some of the fluid received at the inlet probe to the outlet probe without the diverted fluid entering the tank.

10. The fluid injection system of claim 7, wherein the tank head comprises a dual tank head, wherein the dual tank head comprises a first metering gauge for use with dry soluble product and a second metering gauge for use with liquid products.

11. The fluid injection system of claim 7, wherein the metering gauge includes a metering adjustment valve for adjusting the flow rate of fluid into the tank.

12. The fluid injection system of claim 7, wherein the arc on the inlet probe has a radius of approximately 45-degrees.

13. The fluid injection system of claim 7, wherein the angled cut on the outlet probe has an angle of approximately 30-55 degrees.

* * * * *